US007942173B2

(12) United States Patent
Morimoto et al.

(10) Patent No.: US 7,942,173 B2
(45) Date of Patent: May 17, 2011

(54) POWDER FILLING DEVICE

(75) Inventors: Shuji Morimoto, Suita (JP); Takeichiro Sogo, Osaka (JP); Yasutaro Wada, Suita (JP)

(73) Assignees: Morimoto-Pharma Co., Ltd., Suita-shi (JP); Unitec Co., Ltd., Osaka-shi (JP); Pharma-Tech Co., Ltd., Suita-shi (JP)

( * ) Notice: Subject to any disclaimer, the term of this patent is extended or adjusted under 35 U.S.C. 154(b) by 353 days.

(21) Appl. No.: 12/278,318

(22) PCT Filed: Feb. 6, 2007

(86) PCT No.: PCT/JP2007/051980

§ 371 (c)(1),
(2), (4) Date: Aug. 5, 2008

(87) PCT Pub. No.: WO2007/091540

PCT Pub. Date: Aug. 16, 2007

(65) Prior Publication Data

US 2009/0020563 A1 Jan. 22, 2009

(30) Foreign Application Priority Data

Feb. 6, 2006 (JP) ..... 2006-028272

(51) Int. Cl.
*B67C 3/26* (2006.01)

(52) U.S. Cl. ..... 141/256; 141/67

(58) Field of Classification Search ..... 141/67, 141/83, 95, 256, 301
See application file for complete search history.

(56) References Cited

U.S. PATENT DOCUMENTS

| | | | | |
|---|---|---|---|---|
| 6,196,278 | B1 * | 3/2001 | Wegman et al. | 141/65 |
| 6,340,036 | B1 * | 1/2002 | Toyoizumi et al. | 141/275 |
| 7,302,975 | B2 * | 12/2007 | Wegman | 141/80 |
| 7,540,310 | B2 * | 6/2009 | Huss | 141/129 |

FOREIGN PATENT DOCUMENTS

| | | |
|---|---|---|
| JP | 49-968 | 1/1974 |
| JP | 64-84801 | 3/1989 |
| JP | 3-35002 | 4/1991 |
| JP | 10-297601 | 11/1998 |

* cited by examiner

*Primary Examiner* — Timothy L Maust
(74) *Attorney, Agent, or Firm* — Rankin, Hill & Clark LLP

(57) ABSTRACT

A powder filling apparatus that can prevent a screw portion of an auger screw from contacting an inner surface of a metering portion at a funnel lower end portion. The powder filling apparatus includes a funnel that contains powder, and a circular-cylindrical metering portion provided at a lower end portion of the funnel, an auger screw arranged vertically, and a support device that supports the auger screw rotatably. The auger screw has a lower end provided with a screw portion that is arranged within the metering portion. The funnel is suspended from the support device and supported thereto and the metering portion has a center axis made substantially coincident with an axis of rotation of the auger screw.

16 Claims, 5 Drawing Sheets

POWDER FILLING DEVICE

TECHNICAL FIELD

The present invention relates to a power filling apparatus for filling a predetermined amount of powder such as pharmaceuticals into a vial or the like containers by an auger screw and more particularly concerns a powder filling apparatus which can prevent a screw portion of the auger screw from contacting an inner surface of a metering portion at a funnel lower end portion and besides facilitate the assembling work as well as be made compact and put into practice at a low cost.

BACKGROUND ART

A conventional example of the apparatus which fills a given amount of powder medicines into a vial or the like containers utilizes an auger screw (see, e.g., Patent Literature 1).

More specifically, as shown in FIG. 5, this conventional powder filling apparatus 51 comprises a funnel 52 which contains the powder, a funnel support 54 which supports the funnel 52 above a placing pedestal 53, a circular-cylindrical metering portion 55 provided at a lower end portion of the funnel 52, an auger screw 57 having a lower end provided with a screw portion 56, and a screw support 58 which supports an upper end portion of the auger screw 57 rotatably, wherein the funnel support 54 is fixed to the screw support 58 through a support column 59 and the screw portion 56 is arranged within the metering portion 55. The vial and the like container 60 is carried onto the placing pedestal 53 and placed below the metering portion 55. Upon the rotation of the auger screw 57, the powder within the funnel 52 is fed out of the metering portion 55 by a predetermined amount and filled into the container 60.

The auger screw 57 has an upper end portion to which there is attached a pulley 61 in association with a motor 62 attached to the screw support 58. The auger screw 57 has an axis of rotation made coincident with a center axis 64 of the metering portion 55 so as for the screw portion 56 not to contact an inner surface of the metering portion 55 when the auger screw 57 is rotated through this pulley 61. Further, as for a general powder filling apparatus, if the screw portion contacts the metering portion, the contact is not detected. Should they contact with each other, in many cases they are operated as they remain mutually in contact. However, the conventional art is equipped with a contact-detection means 65 which measures the exciting state between the metering portion 55 and the screw portion 56 so that the contact can be detected should both of them be brought into contact with each other.

According to the conventional art, it is required to make the axis of rotation 63 of the auger screw 57 precisely coincident with the center axis 64 of the metering portion 55 so as not to contact the inner surface of the metering portion 55 with the screw portion 56. This entails the following problems.

(1) The funnel must be precisely positioned for installation at a predetermined position where the center axis of the metering portion is coincident with the rotation axis of the auger screw. However, since this funnel is supported on a funnel support, which is a member separate from the screw-support portion, it is not easily positioned nor readily assembled because it should be installed to the funnel-support without any backlash.

(2) The funnel support is connected to the screw support through a vertical support column. This invites a necessity that the support column, the screw-support portion and the funnel-support have to be made robust so as not to produce strain or the like torsion therebetween with the result of causing problems that the equipment becomes large and besides it can be hardly put into practice at a low cost.

(3) Being vertically long, the auger screw needs to be supported by the screw-support portion at two points, one of which is a vertical intermediate portion and the other of which is an upper end portion, so that the rotation axis does not become eccentric. Further, it is preferable to lengthen a distance between both the support points as much as possible. This makes the vertical length of the screw-support portion large to result in causing another problem of enlarging the whole equipment much more.

(4) Additionally, the conventional art is provided with the contact-detection means which measures the exciting state between the screw portion and the metering portion so as to detect the contact therebetween. In normal operation when they don't contact with each other, it is necessary to insulate the funnel with the metering portion and the auger screw with the screw portion from each other so that the contact-detecting means cannot detect the exciting state of both of them. However, the funnel and the auger screw should be precisely positioned and fixed, respectively to the funnel support and the screw-support portion different from each other. This necessity requires to fix the support column 59 to the screw-support portion 58 through a circular-cylindrical insulating member 66, for example, as shown in FIG. 4 and therefore the funnel and the screw portion are not easily insulated.

Patent Literature 1: Patent Application Laid-Open No. 64-84801

DISCLOSURE OF THE INVENTION

The Problem the Invention Attempts to Solve

The present invention has a technical object to solve the above-mentioned problems and provide a powder filling apparatus which can prevent the screw portion of the auger screw from contacting with the inner surface of the circular-cylindrical metering portion at the lower end portion of the funnel and also can facilitate the assembling work and beside can be made compact and put into practice at a low cost.

Means for Solving the Problem

In order to solve the aforesaid problems, the present invention has constructed the powder filling apparatus as follows, for example, if it is explained based on FIGS. 1 to 4 showing an embodiment of the present invention.

More specifically, the present invention is directed to a powder filling apparatus. This power filling apparatus comprises a funnel 2 which contains powder, a circular-cylindrical metering portion 3 provided at a lower end portion of the funnel 2, an auger screw 4 arranged vertically and having a lower end provided with a screw portion 18, and a support means 5 which supports this auger screw 4 rotatably around an axis of rotation 4*a*, wherein the screw portion 18 is arranged within the metering portion 3 and is rotated to feed a predetermined amount of the powder out of the metering portion 3 and fill it into a container 7 disposed therebelow. It is characterized in that the funnel 2 is suspended from the support means 5 and supported thereto and the metering portion 3 has a center axis 3*a* substantially coincident with the axis of rotation 4*a* of the auger screw 4.

Usually, the funnel has an upper opening covered with a closure portion. Thus this closure portion can be connected to the support means and the funnel can be detachably and fixedly attached to an under surface of the closure portion. In this case, this funnel can be easily decomposed, washed and so on by removing from the closure portion. Further it can be assembled without any difficulty into a state where it is precisely positioned.

The closure portion comprises a inner closure member which covers an upper surface within the funnel and a closure frame arranged above the inner closure member. The closure frame can be connected to the support means. Owing to this construction, the powder to be contained in the funnel contacts with the inner closure member but not with the closure frame arranged thereabove. Therefore, for example, on changing the kind of the powder, in the case where the funnel is removed and washed, the inner closure member is detached from the closure frame and subjected to a sterile treatment with heated vapor. But, on the other hand, the closure frame need not undergo the sterile treatment and therefore can remain as connected to the support means.

Further in this case, the closure frame can be formed from an insulating material such as synthetic resin because it need not be subjected to the heat sterile treatment. This entails an advantage to electrically insulate the support means for supporting the closure frame and the funnel fixed to the closure portion so that a contact-detection means to be mentioned later can be easily interposed between the auger screw and the metering portion.

It is possible to provide a cylindrical containing portion between the closure portion and the funnel. Since the funnel is in the form of flaring upwards, the greater its volume, the larger its diameter. On the other hand, in the case of providing the cylindrical containing portion mentioned above, it is sufficient if this cylindrical containing portion has its height increased so as to increase its volume. This makes it possible to restrict the diameter of the funnel and that of the closure portion to smaller ones and as a result confine the installation area of the whole apparatus to a reduced one.

Moreover, as for the power filling apparatus of this kind, as the amount of the powder to be contained above the metering portion becomes less, the metering accuracy tends to be more easily influenced by the variation of the content amount. In consequence, it is preferable to retain the position of the upper surface of the powder to be contained, namely the position of the powder surface, higher than a predetermined position. The provision of the cylindrical containing portion does not make the funnel's diameter excessively large to result in easily securing the height of the powder surface. Further, in this case, if the cylindrical containing portion has at least one part formed from a transparent material or a semitransparent material, its interior area is visible by eyes through the transparent or semitransparent portion to produce an advantage of being able to readily confirm the position of the powder surface.

Besides, the cylindrical containing portion can be made of an insulating material. In this case, the support means and the funnel are electrically insulated from each other. Accordingly, this produces an advantage to readily interpose between the auger screw and the metering portion a contact-detecting means to be mentioned later.

The closure portion may be connected to the support means by suspending around the auger screw a plurality of support columns from the support means and through these supports. Alternatively, a support cylinder extending vertically from the support means may be suspended around the auger screw and have a lower end to which the closure portion may be fixed. In this case, the closure portion can be connected to the support means through the support cylinder assuredly. Thus this is preferable.

Additionally, the support cylinder makes a vertical intermediate portion of the auger screw, which has its upper end supported by the support means, able to be supported. In this case, this support cylinder can effectively utilize a space above the funnel. Therefore, it can retain the whole apparatus small and at the same time can support the vertically elongated auger screw stably so as for its axis of rotation not to become eccentric. Thus this is preferable. The auger screw may have its upper end portion supported directly to the support means or alternatively supported to the support means through the support cylinder.

The auger screw and the metering portion can be electrically connected to each other through the contact-detection means. Thus should the screw portion contact an inner surface of the metering portion, the contact-detection means can detect the contact.

In this case, in a normal operation where the metering portion does not contact the screw portion, it is necessary to mutually insulate the funnel with the metering portion, the auger screw with the screw portion or the support means supporting the auger screw so that the contact-detection means does not detect the exciting state of either of them. As to concrete means of insulating both of them from each other, for example, it is considered that the support means and the funnel are connected to one another through an insulating member like a case where the closure frame is formed from an insulating material or that the closure portion and the funnel are secured to each other through an insulating means like a case where the cylindrical containing portion is made of an insulating material. On the other hand, the funnel comprises a lower funnel portion additionally provided with the metering portion and an upper funnel portion above the lower funnel portion. Then if the lower funnel portion is fixed to the upper funnel portion through an insulating member, since this lower funnel portion is smaller and lighter than the whole funnel, there is produced an advantage to easily fix the lower funnel portion with the metering portion to the auger screw in an insulated state.

Further in this case, the contact-detection means is electrically connected to the auger screw, for example, through the support means and then is electrically connected to the metering portion through the lower funnel portion. However, at this time, when the contact-detection means and the auger screw are electrically connected through the upper funnel and the support means in the mentioned order, it is sufficient if the contact-detection means is wired between the lower funnel portion and the upper funnel portion. This is preferable because the electric circuit can be formed easily.

Effect of the Invention

The present invention is constructed and functions as mentioned above. Consequently, it offers the following effects.

More specifically, the funnel provided at its lower end portion with the metering portion is suspended by the support means which supports the auger screw. Thus it can make the center axis of the metering portion precisely and easily coincident with the rotation axis of the auger screw to set the installation position of the funnel. In consequence, it is possible to readily perform the assembling work in the state where the rotating screw portion is prevented from contacting the inner surface of the metering portion. In addition, since the support means supports both of the funnel and the auger screw, there is no need of taking the strain of the support means or the like into detailed consideration and therefore the whole installation can be made simple and small and be put into practice at a reduced cost.

EXPLANATION OF NUMERALS

Figure 1:
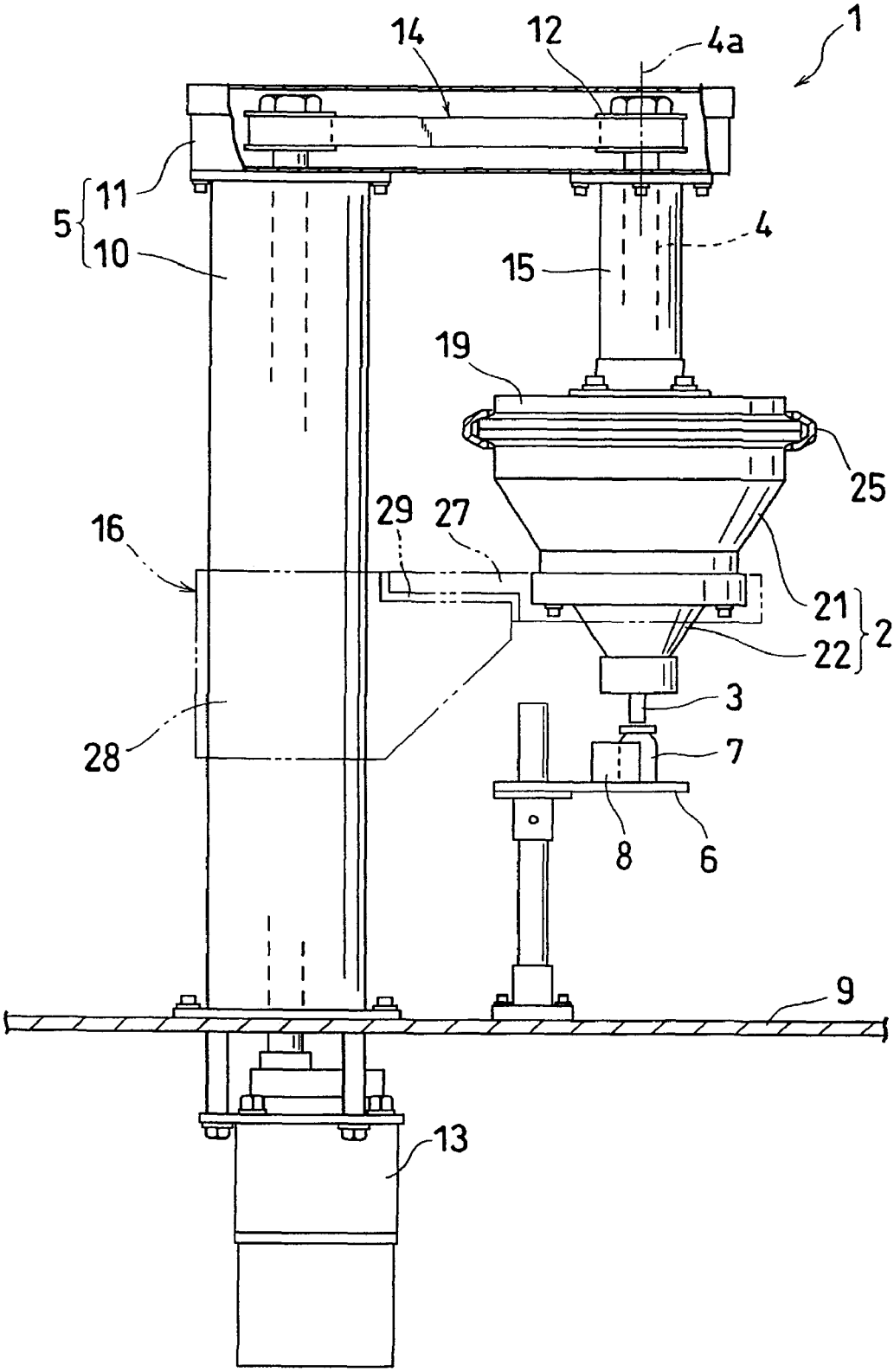
FIG. 1 is a side view, partially broken, of a powder filling apparatus which shows a first embodiment of the present invention.

1 . . . powder filling apparatus
2 . . . funnel
3 . . . metering portion
3*a* . . . center axis of the metering portion (3)
4 . . . auger screw
4*a* . . . axis of rotation
5 . . . support means (support device)
7 . . . container
15 . . . support cylinder
18 . . . screw portion
19 . . . closure portion
19*a* . . . inner closure member
19*b* . . . closure frame
20 . . . cylindrical containing portion circular-cylindrical containing portion)
21 . . . upper funnel portion
22 . . . lower funnel portion
26 . . . insulating member
32 . . . contact-detection means (contact-detection device)

MOST PREFERRED MODE FOR IMPLEMENTING THE INVENTION

Hereafter, an explanation is given for embodiments of the present invention based on the drawings.

Figure 2:
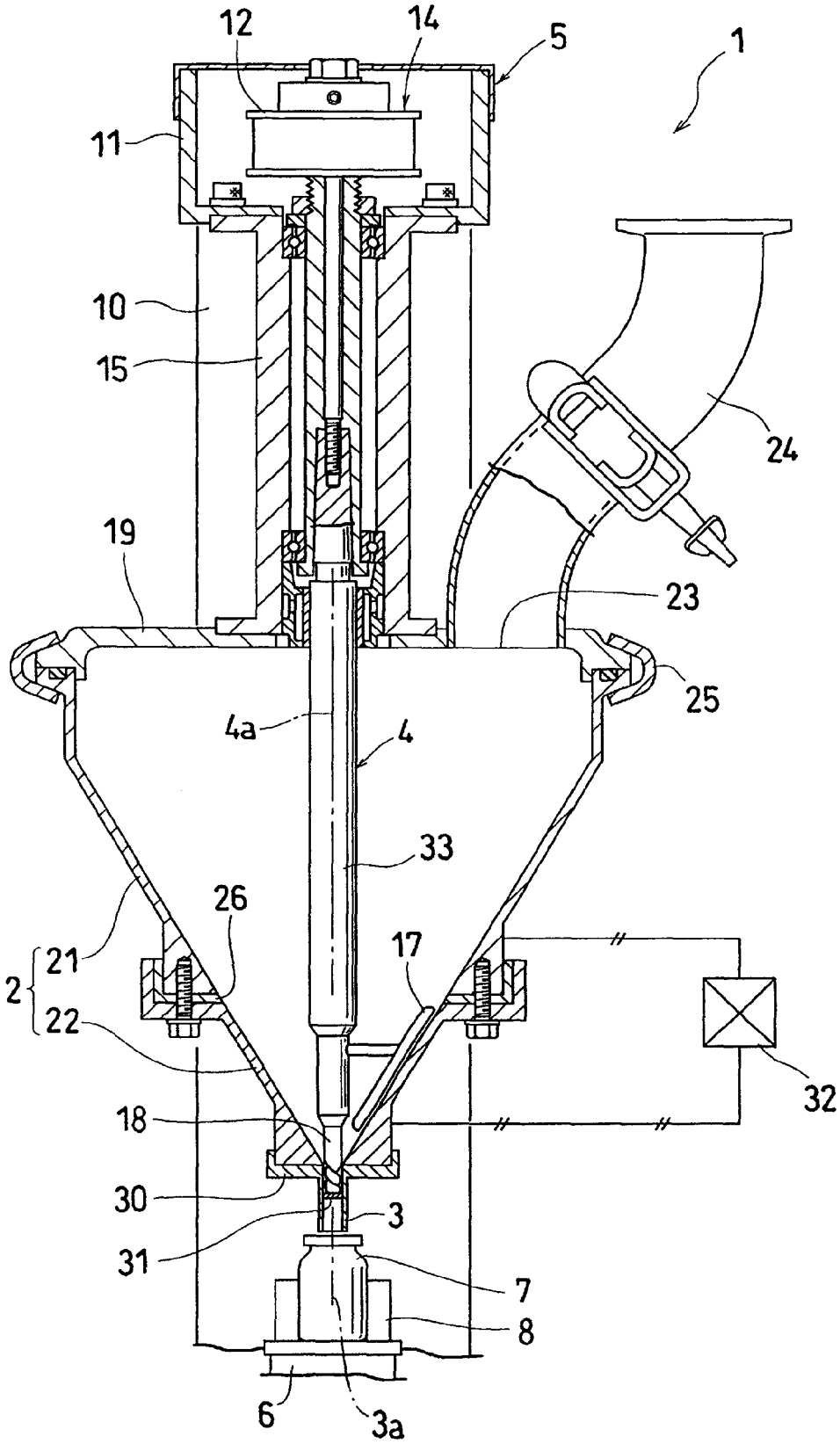
FIG. 2 is a front view, in vertical section, of the powder filling apparatus of the first embodiment of the present invention.
Figure 3:
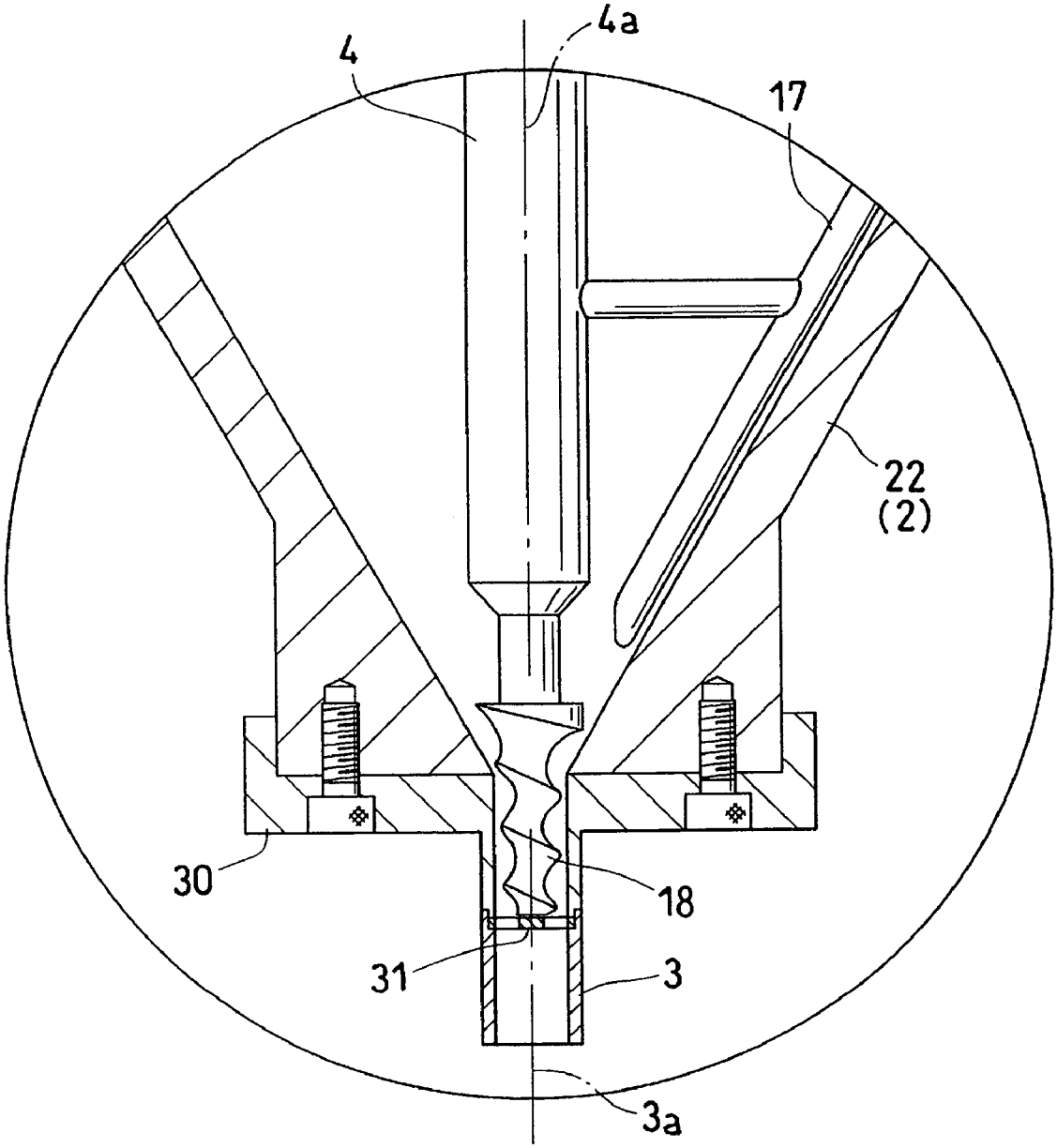
FIG. 3 is an enlarged sectional view of the vicinity of a metering portion of the first embodiment of the present invention.

FIGS. 1 and 3 show an embodiment of the present invention. FIG. 1 is a side view, partly broken, of a powder filling apparatus; FIG. 2 is a front view, in vertical section of the powder filling apparatus; and FIG. 3 is an enlarged sectional view of the vicinity of a metering portion.

As shown in FIG. 1, this powder filling apparatus 1 comprises a funnel 2 which contains powder such as pharmaceuticals, a circular-cylindrical metering portion 3 provided at a lower end portion of the funnel 2, an auger screw 4 extending vertically, and a support device 5 for supporting this auger screw 4 rotatably around an axis of rotation 4*a*. A placing pedestal 6 is provided below the funnel 2. And a container guide 8 is mounted on an upper surface of the placing pedestal 6 so that a vial or the like container 7 can be carried to a position just below the metering portion 3.

The support device 5 comprises a support column 10 supported on an upper surface of a base 9 and a pulley box 11 mounted on an upper end of the support column 10 horizontally. The auger screw 4 has an upper end provided with a pulley 12, which is transmission-connected to a motor 13 attached to the base 9 through the support column 10 and a transmission mechanism 14 within the pulley box 11.

The pulley box 11 has an under surface from which a vertically extending support cylinder 15 is suspended, a lower end portion of which the funnel 2 is fixed to through a closure portion 19. The auger screw 4 is inserted through the support cylinder 15 into the funnel 2.

Although the funnel 2 is fixed to a predetermined position of the lower end of the support cylinder 15 and supported thereto, as shown in FIG. 1 by an imaginary line, the funnel 2 may be auxiliary supported by a funnel-support member 16 attached to the support column 10 from below.

As shown in FIG. 2, the auger screw 4 has its upper end portion supported to the support device 5 through an upper end of the support cylinder 15 and has an vertical intermediate portion supported to a lower side portion of the support cylinder 15. In consequence, since this vertically elongated auger screw 4 is supported at two points of its upper end portion and intermediate portion to the support cylinder 15, it can be supported stably so as for the rotation axis 4*a* not to become eccentric. In this auger screw 4, an agitating blade 17 that rotates within the funnel 2 is disposed in proximity to an inner peripheral surface of the funnel 2. Besides, the auger screw 4 has at its lower end a screw portion 18, which is arranged within the metering portion 3.

The funnel 2 consists of an upper funnel portion 21 like a hopper and a lower funnel portion 22 below the upper funnel portion 21. The closure portion 19 is connected and fixed at its mid portion to the support cylinder 15 and has its upper surface opened to provide a throw-inlet 23 to which a powder throw-in passage 24 is connected. The upper funnel portion 21 is removably fixed to a predetermined position of an under surface of the closure portion 19 by a fastener 25 such as a ferule-clamp. The lower funnel portion 22 is fixed to an under surface of the upper funnel portion 21 through an insulating member 26.

Further, as shown by an imaginary line in FIG. 1, in the event that the funnel-support member 16 supports the lower funnel portion 22, an insulating member 29 is arranged between a leading member 27 which supports the lower funnel portion 22 and a base member 28 that is fixed to the support column 10.

As shown in FIGS. 2 and 3, the metering portion 3 has a flange 30 fixed to an under surface of the lower funnel portion 22. There is transversely arranged a screen 31 provided with a plurality of perforations within the metering portion 3. The screw portion 18 is disposed immediately above this screen 31 so as not to contact the screen 31 and an inner surface of the metering portion 3.

The closure portion 19, the upper funnel portion 21, the lower funnel portion 22, the flange 30 of the metering portion 3 are attached, respectively to predetermined positions of an upper member assuredly so that the center axis 3*a* of the metering portion 3 can be substantially coincident with the rotation axis 4*a* of the auger screw 4. Thus upon the rotation of the auger screw 4, the screw portion 18 is prevented from contacting the inner surface of the metering portion 3. And when the screw portion 18 is rotated, a predetermined amount of the powder in correspondence with the rotation passes through the screen 31 and is fed out of the metering portion 3 to be filled into the container 7.

As shown in FIG. 2, the upper funnel portion 21 and the lower funnel portion 22 are electrically connected to each other through a contact-detection device 32. An insulating member 26 being interposed between the upper funnel portion 21 and the lower funnel portion 22, in a normal operation the contact-detection device 32 cannot detect the exciting state. However, owing to the support structure, the upper funnel portion 21 is electrically connected to the auger screw 4 through the closure portion 19, the support cylinder 15 and the support device 5, while the lower funnel portion 22 is electrically connected to the metering portion 3. In consequence, the metering portion 3 is electrically connected to the auger screw 4 through the contact-detection device 32. Thus when the auger screw 4 has the screw portion 18 at its lower end brought in contact with the inner surface of the metering portion 3, the contact-detection device 32 detects the excitation to sense that both of them is in contact with each other.

Should the screw portion 18 contact the inner surface of the metering portion 3 or when the kind of the powder within the funnel 2 is changed, the metering portion 3 and the funnel 2 are removed from the support cylinder 15 and then decomposed and washed. If required, the screw portion 18 is dismantled from a screw axis 33 of the auger screw 4 and washed. Thereafter, the screw portion 18 is assembled to the screw axis 33, and the closure member 19, the upper funnel portion 21, the lower funnel portion 22 and the metering portion 3 are attached to predetermined positions in order. At this time, every member is attached below the support cylinder 15 in order, so that the position for attaching every member can be adjusted easily.

Figure 4:
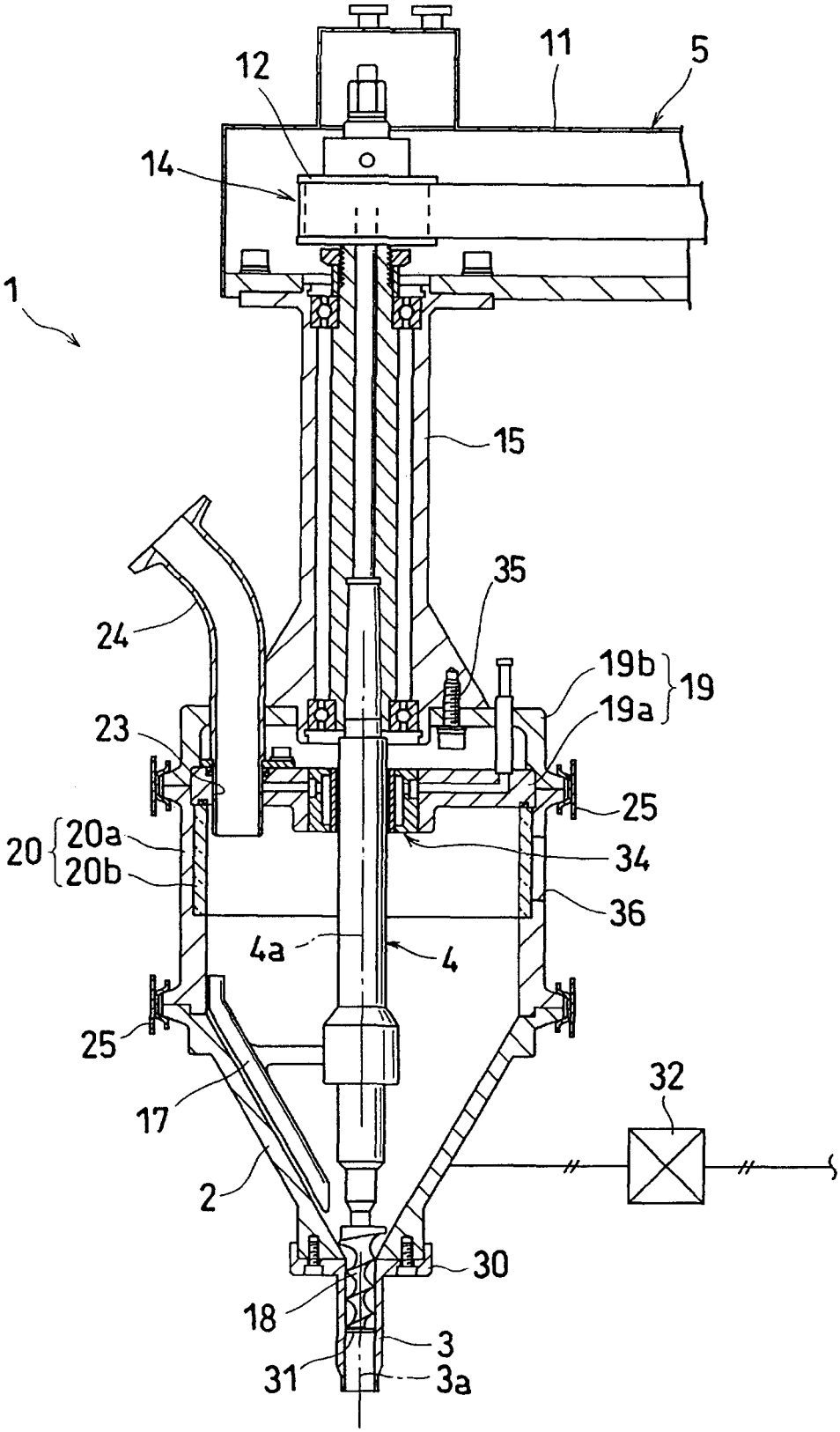
FIG. 4 is a sectional view of an essential part of a powder filling apparatus in accordance with a second embodiment of the present invention.
Figure 5:
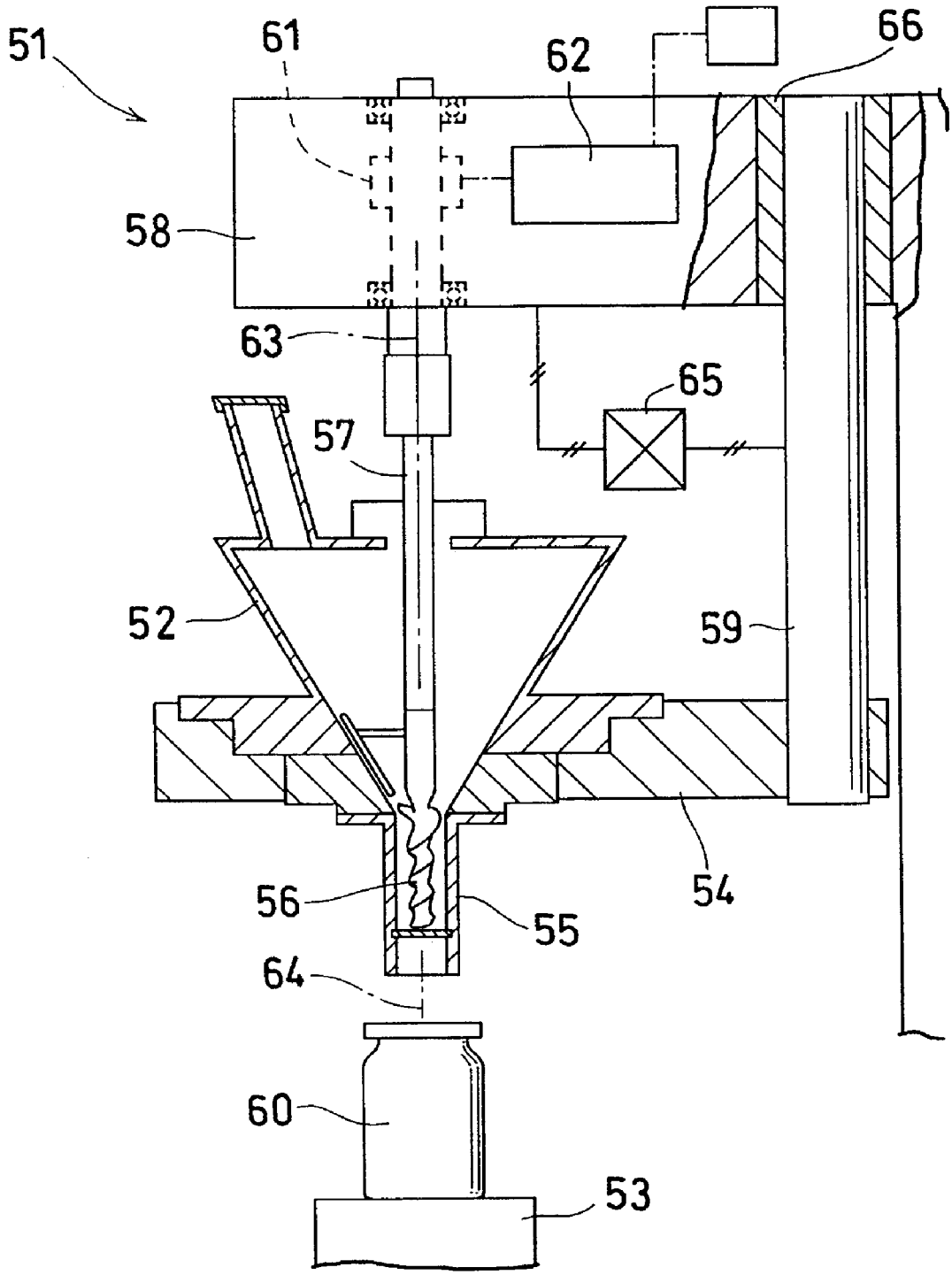
FIG. 5 is a side view, in vertical section, of a powder filling apparatus which shows a conventional art.

FIG. 4 shows a second embodiment of the present invention and is a sectional view of an essential portion of the powder filling apparatus.

In this second embodiment, like the first embodiment, a support cylinder 15 is suspended from a pulley box 11 of the support device 5 and the auger screw 4 inserted through the support cylinder 15 has an upper end portion and a vertical intermediate portion supported rotatably by the inner surface of the support cylinder 15.

The support cylinder 15 has a lower end, to which the funnel 2 is fixed through the closure member 19 and the circular-cylindrical containing portion 20 in the mentioned order, differently from the first embodiment. This funnel 2 has the lower end portion provided with the metering portion 3 similarly with the first embodiment. This metering portion 3 has its center axis 3*a* substantially coincident with the rotation axis 4*a* of the auger screw 4.

In this second embodiment, the closure portion 19 consists of an inner closure member 19*a* which covers an upper surface within the funnel 2 or the circular-cylindrical containing portion 20 and a closure frame 19*b* disposed above this inner closure member 19*a*.

The inner closure member 19*a* is formed from a metal material of excellent heat-resistant property, corrosion-resistant property and chemical-proof property, such as stainless steel. Its peripheral edge portion is assuredly held between a peripheral edge of the closure frame 19*b* and an upper end of the circular-cylindrical containing portion 20. This inner closure member 19*a* has a mid portion through which the auger screw 4 is inserted. But this auger screw 4 is retained as it is non-contacted with the inner closure member 19*a* mutually. An air-seal mechanism 34 seals a space between both of them.

The closure frame 19*b* has an upper surface surely fixed to the support cylinder 15 by a fixing bolt 35 and has a peripheral edge portion removably secured to an upper end portion of the circular-cylindrical containing portion 20 through a fastener 25. The closure frame 19*b* is formed from a synthetic resin excellent in mechanical strength, such as fluororesin, ultra-high molecular polyethylene resin, high-density polypropylene resin, polyacetal resin and polyamide resin. The support cylinder 15 and the circular-cylindrical containing portion 20 are electrically insulated by the closure frame 19*b*. Thus, differently from the first embodiment, the funnel 2 is formed into a vertically integral structure. The contact-detection device 32 electrically connects the funnel 2 to for example, the support device 5.

The circular-cylindrical containing portion 20 has its lower end portion to which the funnel 2 is detachably fixed by the fastener 25. This circular-cylindrical containing portion 20 comprises a main body 20*a* made of, for example, stainless steel and a glass transparent cylinder 20*b* fitted into an upper side portion of the body 20*a*. This main body 20*a* has the upper side portion which is partly cut out to provide a see-through window 36, through which an interior area of the circular-cylindrical containing portion 20 is visible by eyes as well as that of the funnel 2. In consequence, although the transparent cylinder 20*b* may be semitransparent, it is more preferably transparent so that the interior area of the funnel 2 is visible by eyes well.

Further, in this embodiment, the transparent cylinder 20*b* which constitutes part of the cylindrical containing portion is formed from a transparent material. However, in the present invention, for example, the circular-cylindrical containing portion 20 may be formed from a transparent material in its entirety so that the interior area of the cylindrical containing portion is visible as well as that of the funnel.

The funnel 2 and the circular-cylindrical containing portion 20 are removed from the closure portion 19 by loosening the fastener 25 and then washed and sterilized. At this time, the inner closure member 19*a* which contacts the powder within the funnel 2 in use is also dismantled and similarly washed and sterilized. On the other hand, the closure frame 19*b* which does not contact the powder need not be washed and sterilized and therefore remain fixed to the support cylinder 15 without being removed therefrom. For this reason, it is possible to perform the decomposing and assembling work simply. The other construction is the same as that of the first embodiment and functions in the same manner. Therefore, its explanation is omitted.

The powder filling apparatus explained in the above embodiments are illustrated only for example so as to realize the technical idea of the present invention. Therefore, the shape, structure and arrangement of each of the funnel, metering portion, auger screw, screw portion, support means, cylinder member, closure portion, cylindrical containing portion, contact-detection means or the like are not limited to those of the embodiments, but various modifications can be added thereto as far as they fall within the scope of claims of the present invention.

For instance, in the first embodiment, the funnel consists of the upper funnel portion and the lower funnel portion between both of which an insulating member is arranged and in the second embodiment, the closure frame is formed from an insulating material. However, according to the present invention, instead of this construction, the cylindrical containing portion may be formed from an insulating material. In this case, the closure frame can be made of a metal material. Additionally, in accordance with the present invention, an insulating member may be interposed at any position between the support cylinder and the closure portion, between the closure portion and the cylindrical containing portion, or between the cylindrical containing portion and the funnel, further between the closure portion and the funnel in the case where the cylindrical containing portion is not used. The contact-detection means may electrically connect the support means, or the base or the like to which the support mean is fixed to the metering portion. Moreover, in the above embodiments, an explanation was given for the case where the pharmaceutical or the like powder is filled into a vial, but needless to say, the kind of the powder and the shape of the container are not limited to those.

INDUSTRIAL AVAILABILITY

The powder filling apparatus of the present invention can prevent the screw portion of the auger screw and the lower end portion of the funnel from contacting the inner surface of the metering portion and besides facilitates the assembling work. Further, it can be made compact and can be put into practice at a low cost. Therefore, it is suitably used particularly for filling powder like pharmaceuticals, but may be suitably employed for filling various sorts of power such as foods or industrial ones.

The invention claimed is:

1. A powder filling apparatus comprising a funnel (2) which contains powder, a circular-cylindrical metering portion (3) provided at a lower end portion of the funnel (2), an auger screw (4) arranged vertically and having a lower end provided with a screw portion (18), and a support means (5) which supports the auger screw (4) rotatably around an axis of rotation (4*a*), the screw portion (18) being arranged within the metering portion (3), upon the rotation of the screw portion (18), a predetermined amount of the powder being fed out of the metering portion (3) and filled into a container (7) disposed therebelow, wherein the funnel (2) is suspended from the support means (5) and supported thereto and the metering portion (3) has its center axis (3*a*) made substantially coincident with the rotation axis (4*a*) of the auger screw (4), wherein the funnel (2) is provided with a closure portion (19), the closure portion (19) being connected to the support means (5) and having an under surface to which the funnel (2) is removably fixed, and wherein the closure portion (19) comprises an inner closure member (19*a*) which covers an upper surface within the funnel (2) and a closure frame (19*b*) disposed above the inner closure member (19*a*), the closure frame (19*b*) being connected to the support means (5).

2. The powder filling apparatus as set forth in claim 1, wherein the closure frame (19*b*) comprises an insulating material.

3. The powder filling apparatus as set forth in claim 1, wherein a cylindrical containing portion (20) is provided between the closure portion (19) and the funnel (2).

4. The powder filling apparatus as set forth in claim 3, wherein the cylindrical containing portion (20) is partly formed from a transparent material or a semitransparent material.

5. The powder filling apparatus as set forth in claim 3, wherein the cylindrical containing portion (20) is formed from an insulating material.

6. The powder filling apparatus as set forth in claim 1, wherein a support cylinder (15) extending vertically from the support means (5) is suspended around the auger screw (4) and has a lower end portion to which the closure portion (19) is secured.

7. The powder filling apparatus as set forth in claim 6, wherein the auger screw (4) has an upper end portion supported to the support means (5) and a vertical intermediate portion supported to the support cylinder (15).

8. The powder filling apparatus as set forth in claim 1, wherein the metering portion (3) and the auger screw (4) are electrically connected to each other through a contact-detection means (32).

9. The powder filling apparatus as set forth in claim 8, wherein the funnel (2) comprises a lower funnel portion (22) additionally provided with the metering portion (3) and an upper funnel portion (23) thereabove, the lower funnel portion (22) being fixed to the upper funnel portion (21) through an insulating member (26), the contact-detection means (32) being electrically connected to the auger screw (4) through the support means (5) and to the metering portion (3) through the lower funnel portion (22).

10. The powder filling apparatus as set forth in claim 9, wherein the contact-detection means (32) is electrically connected to the auger screw (4) through the upper funnel portion (21) and the support means (5) in the mentioned order.

11. The powder filling apparatus as set forth in claim 2, wherein a cylindrical containing portion (20) is provided between the closure portion (19) and the funnel (2).

12. The powder filling apparatus as set forth in claim 3, wherein a support cylinder (15) extending vertically from the support means (5) is suspended around the auger screw (4) and has a lower end portion to which the closure portion (19) is secured.

13. The powder filling apparatus as set forth in claim 12, wherein the auger screw (4) has an upper end portion supported to the support means (5) and a vertical intermediate portion supported to the support cylinder (15).

14. The powder filling apparatus as set forth in claim 13, wherein the metering portion (3) and the auger screw (4) are electrically connected to each other through a contact-detection means (32).

15. The powder filling apparatus as set forth in claim 14, wherein the funnel (2) comprises a lower funnel portion (22) additionally provided with the metering portion (3) and an upper funnel portion (23) thereabove, the lower funnel portion (22) being fixed to the upper funnel portion (21) through an insulating member (26), the contact-detection means (32) being electrically connected to the auger screw (4) through the support means (5) and to the metering portion (3) through the lower funnel portion (22).

16. The powder filling apparatus as set forth in claim 15, wherein the contact-detection means (32) is electrically connected to the auger screw (4) through the upper funnel portion (21) and the support means (5) in the mentioned order.

* * * * *